US007934273B1

(12) United States Patent
Goettl et al.

(10) Patent No.: US 7,934,273 B1
(45) Date of Patent: May 3, 2011

(54) METHOD FOR RELIEVING SUCTION FORCE IN A POOL DRAIN

(75) Inventors: John M. Goettl, Phoenix, AZ (US); R. Dominic Conn, Tempe, AZ (US); Steven R. Barnes, Maricopa, AZ (US)

(73) Assignee: Paramount Pool & Spa Systems, Chandler, AZ (US)

( * ) Notice: Subject to any disclaimer, the term of this patent is extended or adjusted under 35 U.S.C. 154(b) by 833 days.

(21) Appl. No.: 11/924,489

(22) Filed: Oct. 25, 2007

Related U.S. Application Data

(60) Continuation-in-part of application No. 11/457,361, filed on Jul. 13, 2006, now abandoned, which is a division of application No. 11/319,638, filed on Dec. 28, 2005, now Pat. No. 7,089,606, which is a division of application No. 11/008,767, filed on Dec. 8, 2004, now Pat. No. 7,055,189, which is a division of application No. 10/417,872, filed on Apr. 16, 2003, now Pat. No. 6,895,608.

(51) Int. Cl.
*E04H 4/00* (2006.01)

(52) U.S. Cl. ..... 4/504; 4/661

(58) Field of Classification Search ..... 4/504, 507–509, 4/661

See application file for complete search history.

(56) References Cited

U.S. PATENT DOCUMENTS

| | | | | | |
|---|---|---|---|---|---|
| 3,026,903 | A * | 3/1962 | Roach | 137/533.13 |
| 4,552,331 | A * | 11/1985 | Smart, Jr. | 4/406 |
| 4,602,391 | A * | 7/1986 | Shepherd | 4/504 |
| 5,265,631 | A | 11/1993 | Goettl | 134/111 |
| 5,365,617 | A | 11/1994 | Tarr | 4/508 |
| 5,682,624 | A * | 11/1997 | Ciochetti | 4/509 |
| 5,822,807 | A | 10/1998 | Gallagher et al. | 4/507 |
| 5,878,773 | A | 3/1999 | Robol | 137/112 |
| 5,894,609 | A * | 4/1999 | Barnett | 4/504 |
| 5,947,700 | A | 9/1999 | McKain et al. | 417/306 |
| 5,991,939 | A | 11/1999 | Mulvey | 4/504 |
| 6,098,654 | A | 8/2000 | Cohen et al. | 137/467 |
| 6,295,661 | B1 * | 10/2001 | Bromley | 4/504 |
| 6,341,387 | B1 | 1/2002 | Zars | 4/504 |
| 6,779,205 | B2 * | 8/2004 | Mulvey et al. | 4/509 |
| 6,935,364 | B1 * | 8/2005 | Tarazona et al. | 137/529 |

* cited by examiner

*Primary Examiner* — Khoa D Huynh
(74) *Attorney, Agent, or Firm* — Booth Udall, PLC

(57) ABSTRACT

Methods of relieving the suction force in a swimming pool or spa. A first method may include the steps of closing an aperture in a hydraulic suction fuse through magnetic force and opening the aperture by increasing suction force within the hydraulic suction fuse. Implementations of hydraulic suction fuses may also utilize a method of adjusting the fuse point of a hydraulic suction fuse. The method may include decoupling a magnet assembly from a first step having a first height, the first step contained in a fuse body contained in the hydraulic suction fuse. The method may also include rotating the magnet assembly and coupling the magnet assembly with a second step having a second height, the second step contained in the fuse body.

18 Claims, 11 Drawing Sheets

METHOD FOR RELIEVING SUCTION FORCE IN A POOL DRAIN

CROSS REFERENCE TO RELATED APPLICATIONS

This application is a continuation-in-part of application Ser. No. 11/457,361, filed Jul. 13, 2006, entitled "METHOD FOR RELIEVING SUCTION FORCE IN A POOL DRAIN" to Goettl, which application is a division of and claims priority to an application entitled "A MANUALLY RESETTABLE HYDRAULIC SUCTION FUSE FOR SWIMMING POOLS", assigned Ser. No. 11/319,638, filed Dec. 28, 2005, now U.S. Pat. No. 7,089,606, issued Aug. 15, 2006, which application is a division of and claims priority to an application entitled "HYDRAULIC SUCTION FUSE FOR SWIMMING POOLS", assigned Ser. No. 11/008,767, filed Dec. 8, 2004, now U.S. Pat. No. 7,055,189, issued Jun. 6, 2006, which application is a division of and claims priority to an application entitled "HYDRAULIC SUCTION FUSE FOR SWIMMING POOL", filed Apr. 16, 2003, assigned Ser. No. 10/417,872, now U.S. Pat. No. 6,895,608, issued May 24, 2005, the disclosures of which are hereby incorporated herein by reference.

BACKGROUND OF THE INVENTION

Typically, swimming pools include a pump for drawing water from a drain at the bottom of a pool through a debris collection trap to a filter from which the water is returned to the pool. Most pools also include a skimmer in fluid communication with the debris collection trap. A typical debris collection trap of this type is illustrated and described in U.S. Pat. No. 5,265,631, which patent describes an invention by the present inventor and is assigned the present assignee.

The drain at the bottom of a swimming pool can pose a safety hazard to an occupant of the pool, particularly a young child or a person of limited physical strength. As water is drawn through the drain by the pump, a suction force exists at the surface of the drain. Should a user of a pool inadvertently cover the drain with a part of his/her body, the suction force will tend to retain the user against the drain unless the user has sufficient strength to push away from the drain. If such strength is not available or if the user panics, drowning may result. Furthermore, even if the user is capable of pushing away from the drain, injury of more or less seriousness may result.

To overcome the potential for injury or drowning due to being drawn against and retained by a swimming pool drain, various devices have been developed over the years to break the pump suction in the event a high suction condition is sensed due to covering or at least restricting the flow of water through the drain. Some of these devices introduce air to the inlet side of the pump in response to the sensed high suction condition, which results in loss of pump prime. Other devices interrupt the power source to the pump and the pump ceases to operate. There are also devices which provide for a conduit open to the atmosphere that is submerged a given distance below the pool water level and connected to the pump inlet to introduce air if a predetermined level of suction is sensed.

There are numerous problems attendant existing prior art devices, which problems will be summarized below. Many of the devices are very expensive and have many moving parts. Some of the devices provide false signals triggered by partly or wholly filled pump and/or skimmer baskets. Installation of some devices may require several feet of excavation for installation purposes which render them expensive and the resulting deterrent may preclude installation. Depending upon the system installed, the pump may be damaged upon actuation with the resulting attendant problems of expense and loss of use of the swimming pool.

BRIEF SUMMARY OF THE INVENTION

Implementations of a hydraulic suction fuse may utilize a first method of relieving the suction force in a swimming pool or spa. The method may include the steps of closing an aperture in a hydraulic suction fuse through magnetic force and opening the aperture by increasing suction force within the hydraulic suction fuse. The method may also include the step of drawing air into the hydraulic suction fuse.

Implementations may also utilize a second method for relieving the suction force of a drain in a swimming pool or spa. The method may include the steps of setting a hydraulic suction fuse, opening the hydraulic suction fuse by increasing suction force within the hydraulic suction fuse, and resetting the hydraulic suction fuse through magnetic force.

Implementations of a hydraulic suction fuse utilizing a second method may also utilize one, all, or some of the following:

The resetting of the hydraulic suction fuse may include automatically resetting the hydraulic suction fuse when the suction force is decreased within the hydraulic suction fuse.

The automatically resetting the hydraulic suction fuse may include automatically closing an aperture in the hydraulic suction fuse through the magnetic force.

The resetting of the hydraulic suction fuse may include manually resetting the hydraulic suction fuse.

Implementations of a hydraulic suction fuse may utilize a method of adjusting the fuse point of a hydraulic suction fuse. The method may include decoupling a magnet assembly from a first step having a first height, the first step contained in a fuse body contained in the hydraulic suction fuse. The method may also include rotating the magnet assembly and coupling the magnet assembly with a second step having a second height, the second step contained in the fuse body.

The method may also comprise the step of coupling the magnet assembly with the first step and the second step through a pin.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The present invention will be described with greater specificity and clarity with reference to the following drawings, in which.

DESCRIPTION OF THE INVENTION

Figure 1:
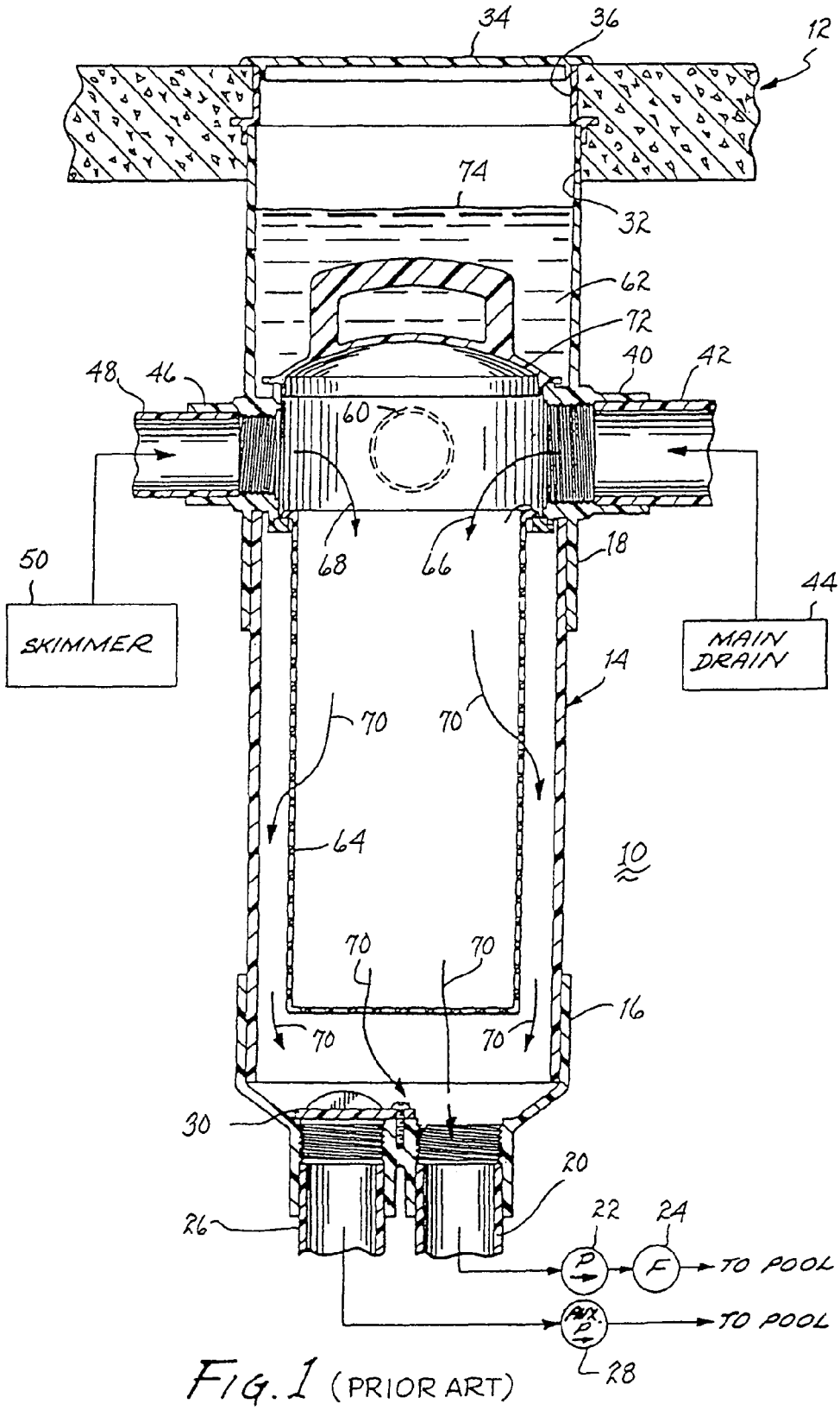
FIG. 1 (PRIOR ART)
FIG. 1 illustrates a conventional prior art debris collection trap for use with a swimming pool.

Referring to FIG. 1, there is illustrated a debris collection trap 10 of the type described in U.S. Pat. No. 5,265,631 (hereinafter referred to as the '631 patent). The trap is located adjacent the side of a swimming pool and recessed below the surface of pool deck 12. Such location permits the trap to be made relatively large for significant capacity without being obtrusive to users of the swimming pool. The trap includes an elongated tank 14 having a bottom closure unit 16 and top inlet unit 18. The closure unit may include a first outflow pipe 20 conveying water to a pump 22 and a filter 24 downstream thereof to filter the water received. The water is then returned to the pool, as indicated. Closure unit 16 may include a second pipe 26 conveying water to an auxiliary pump 28 that provides water to a cooling spray, waterfall, or other water emitting elements attendant the pool, as indicated. A closure 30, such as a pivotal plate illustrated, may be incorporated to selectively limit water flow through pipe 26. The upper extremity of tank 14 is mounted within an opening 32 in pool deck 12. A removable plate 34 supported by the pool deck or by a fitting 36 mounted therein may be employed.

Inlet unit 18 includes a hollow stub 40 for connection to pipe 42 in fluid communication with a drain, such as main drain 44 at the bottom of the swimming pool. A further stub 46 supports a pipe 48 for conveying water from a skimmer 50. An inlet 60 to inlet unit 18 is connected to a balanced line (not shown) for conveying water by gravity from the swimming pool to replenish, as necessary, water 62 within tank 14 above inlet unit 18. A conventional strainer 64 depends from inlet unit 18 and receives water from pipes 42 and 48, along with any debris entrained therein or conveyed thereby, as depicted by arrows 66, 68. The debris flowing into the strainer is retained therein and the water flows out through the strainer and into pipe 20 extending from closure unit 16, as depicted by arrows 70. A cover 72 is detachably attached to inlet unit 18 in sealing engagement therewith. The main purpose of cover 72 is that of providing access to strainer 64 and withdrawal thereof to permit removal of the debris collected therein by drawing the strainer upwardly after removal of plate 34.

In operation, upon actuation of pump 22, water is drawn from within tank 14 and the suction developed within the tank will draw water through main drain 44 and pipe 42 into the tank. Similarly, water will be drawn from skimmer 50 through pipe 48 into the tank. The low pressure or suction within the tank will maintain cover 72 in essentially sealed engagement with inlet unit 18. As inlet 60 is connected via a pipe to the water in the swimming pool, water level 74 of water 62 above cover 72 will be at the same elevation as the water level of the pool. Except for some seepage that may occur due to the below atmosphere pressure within tank 14 below inlet unit 18, water 62 will not mix with the water in the tank below the inlet unit.

Depending in part upon the power of pump 22, the suction (low pressure) within tank 14 may be significant in order to draw water from main drain 44 through pipe 42 into tank 14. This suction pressure (or low pressure) is essentially translated to the opening of the main drain. Should a body part of a person using the swimming pool inadvertently cover the main drain, the resulting suction force (vacuum) would tend to draw the person into contact with the main drain and hold the person there. Should the person be a child or a person of inadequate strength, the person may not be able to move away from the drain and may drown. Furthermore, the person may suffer injuries during efforts to extricate himself/herself away from the drain. If a skimmer 50 is also attached to tank 14 via a pipe 48, the suction otherwise that would be present at the main drain will be somewhat relieved. However, if the skimmer is clogged or nearly clogged, relief of the suction force at the main drain is de minimus.

To prevent the potentially disastrous results of a person becoming captured by the suction force at a main drain of a swimming pool, some mechanism must be employed to minimize or at least reduce the suction force responsible for capturing such person.

Figure 2:
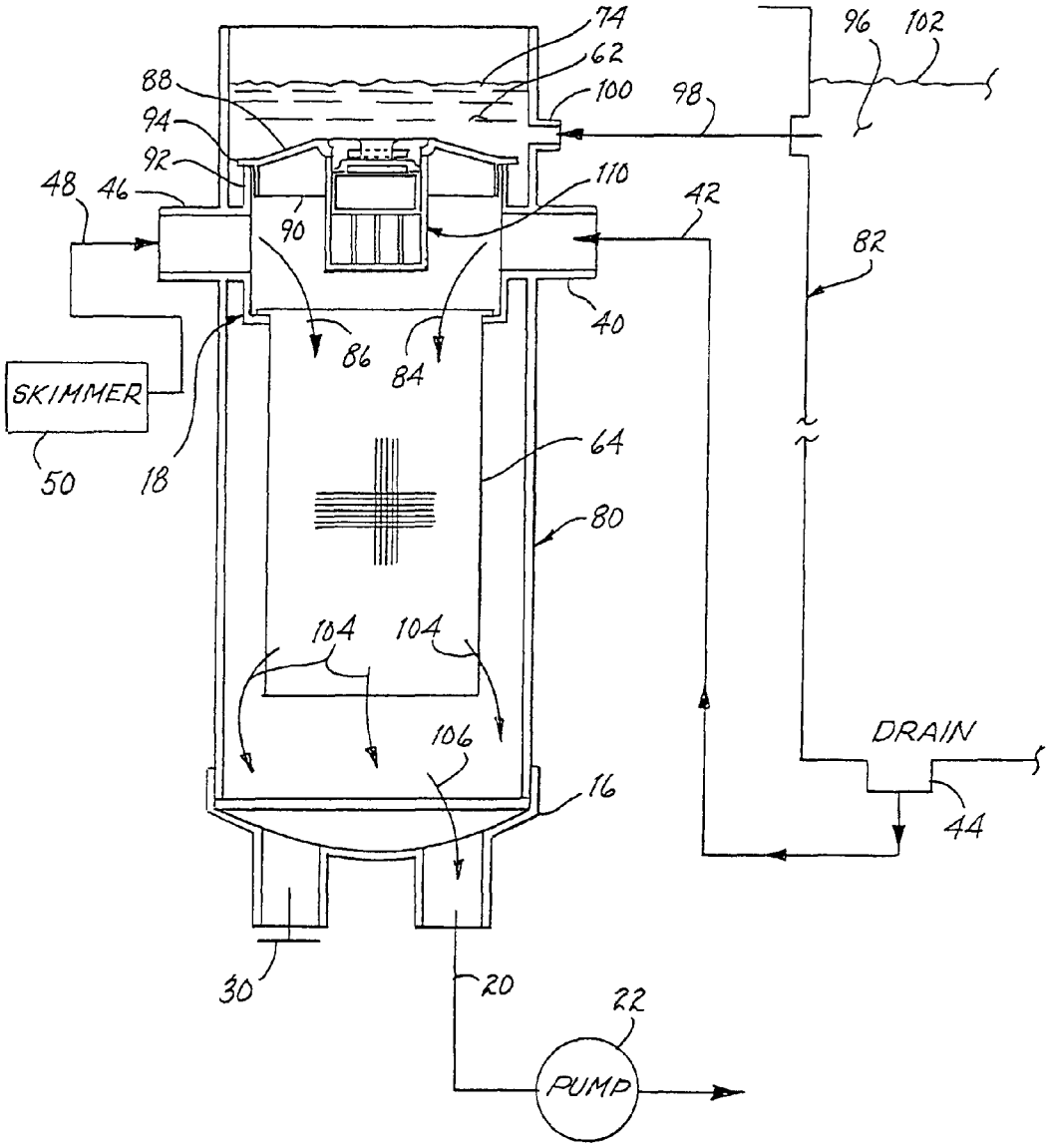
FIG. 2 illustrates a debris collection trap incorporating a hydraulic suction fuse and showing the normal mode of operation.

Referring to FIG. 2, there is illustrated a debris collection trap 80 which may be the same as debris collection trap 10 shown in FIG. 1 or a functional equivalent thereof. In view of the above discussion of debris collection trap 10 shown in FIG. 1, the description of debris collection trap 80 shown in FIG. 2 will be essentially in summary form other than the improvement thereto constituting the present invention. Elements illustrated in FIG. 2 common with elements shown in FIG. 1 will be assigned common reference numerals for identification purposes.

As with debris collection trap 10, debris collection trap 80 is mounted below ground and usually beneath the surface of the deck surrounding a swimming pool, such as pool 82. Inlet unit 18 includes a hollow stub 40 connected to pipe 42 drawing water from drain 44 at the bottom of pool 82. The inflowing water, as a result of suction (low pressure) generated by pump 22 through pipe 20 extending from closure unit 16 enters strainer 64, as depicted by arrow 84. If a skimmer 50 is connected, water is drawn therefrom through pipe 48 into hollow stub 46 and vents into strainer 64, as depicted by arrow 86. A cover 88 is detachably attached to the top of inlet unit 18. It may include a skirt 90 mating with the interior of cylinder 92 at the top of the inlet unit. A circumferential lip 94 rests upon the upper edge of the cylinder to limit movement of cover 88 with respect to the inlet unit. Water 62 above the inlet unit is in fluid communication with water 96 in pool 82 via a pipe or conduit 98 extending from the pool into the debris collection trap via hollow stub 100. Hence, water level 74 at the top of debris collection trap 80 is at the same level as water level 102 in pool 82. As depicted by arrows 104, the water entering strainer 64 flows out of the strainer through the bottom of closure unit 16 into pipe 20, as depicted by arrow 106. The strainer collects the debris, such as leaves, etc., drawn from the pool through drain 44 into the debris collection trap. Upon upward movement of cover 88, the strainer is exposed and it may be removed by lifting it and emptying it at a suitable debris disposal location.

Referring jointly to FIGS. 2, 3A, 3B and 4, hydraulic suction fuse 110 will be described in detail. Cover 88 includes an opening 112 generally centrally located therein and including an inwardly radially extending lip 114 serving in the manner of a shoulder. A disc-like support 116 is disposed within opening 112 and supported by lip 114. It includes a centrally located aperture 118. A magnet, such as a ring magnet 120, is formed in or attached to support 116 in a circumscribing relationship with aperture 118. Support 116 supports a basket 122 extending downwardly therefrom and defined by a plurality of longerons 124 terminated by a base 126, which base may be perforated. A float 128 is captured within basket 122 with the freedom to move vertically within the basket. The float includes a disc 130 of steel or other magnetically responsive material disposed in the upper part of the float. The disc may be fully enclosed, as illustrated, to prevent deterioration by the chemical action of chlorine present in the water of the swimming pool. Similarly, magnet 120 may be fully enclosed within support 116 for the same reason. It is to be understood that the locations of the magnet and the disc may be reversed. Water present within inlet unit 18 (see FIG. 2), will cause float 128 to rise against support 116 and be retained thereagainst by the magnetic force exerted by magnet 120 upon disc 130.

Figure 4:
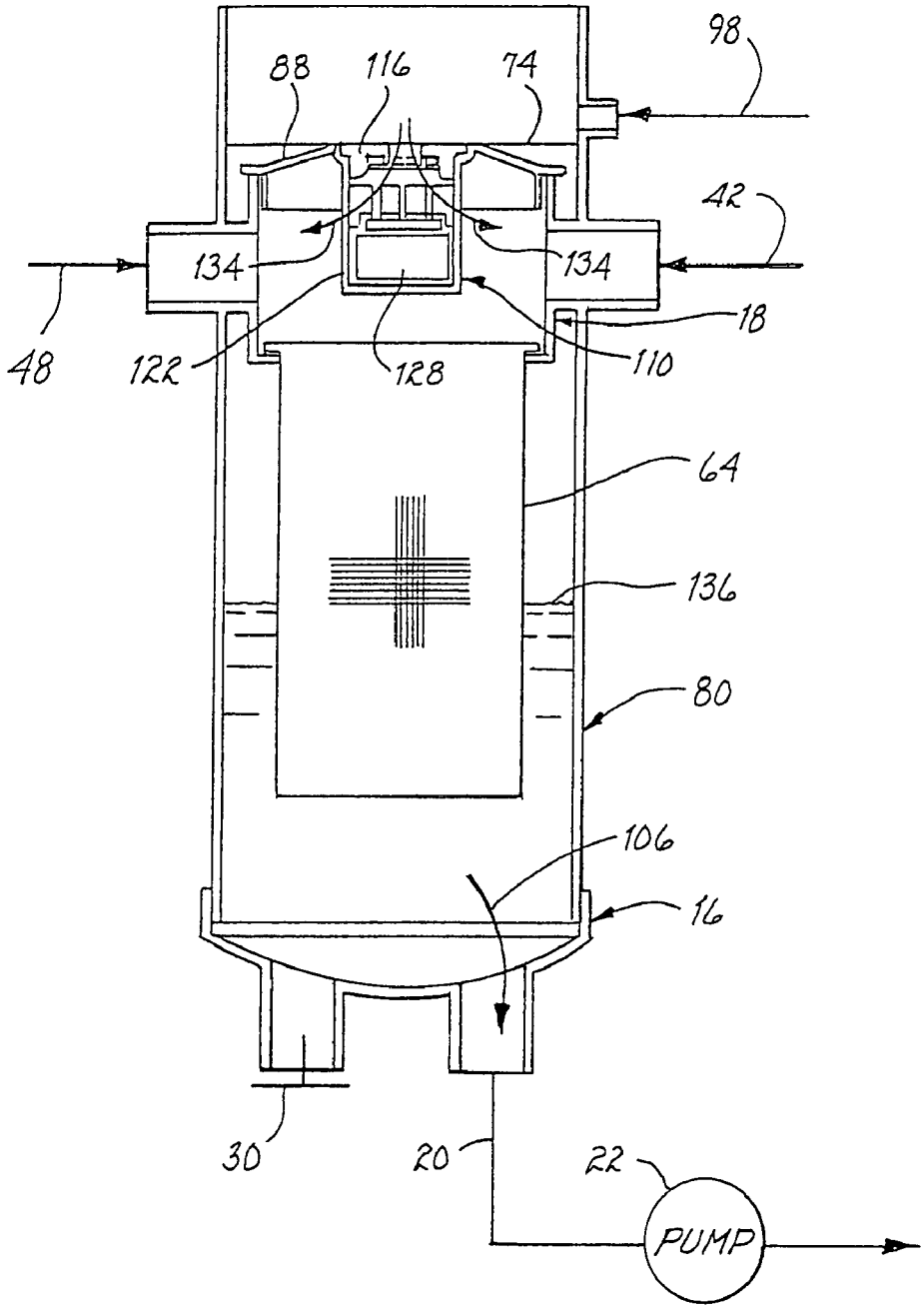
FIG. 4 illustrates a debris collection trap shown in FIG. 2 but wherein the hydraulic suction fuse is in its second state.

When water inflow through pipe 42 (see FIG. 2) into debris collection trap 80 is less than the outflow of water through pipe 20 due to an obstruction at drain 44, water level 136 within the debris collection trap will drop below float 128 and the float will no longer be supported by the water. Additionally, the resulting suction (low pressure) within the debris collection trap relative to the pressure exerted by the head of water 62 above cover 88 will exert a downward force upon float 128. When the combination of lack of water support for the float and the differential pressure acting on the float is sufficient to overcome the magnetic retaining force of permanent, non-electric magnet 120 acting on disc 130, the float will tend to drop downwardly until it comes to rest against base 126, as shown in FIG. 4. When this happens, the suction force that was present at drain 44 will cease to exist, as described below.

Figure 3A:
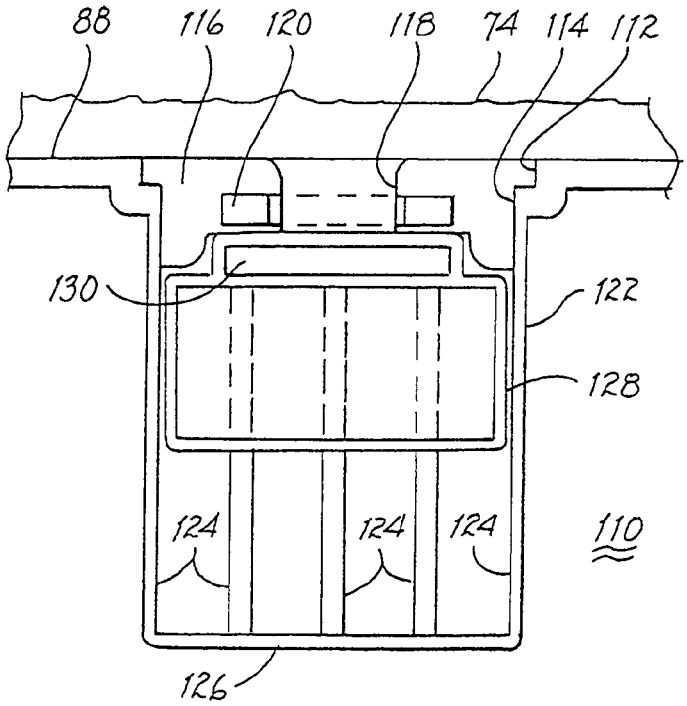
FIG. 3A illustrates a hydraulic suction fuse in a first state representative of normal operation.
Figure 3B:
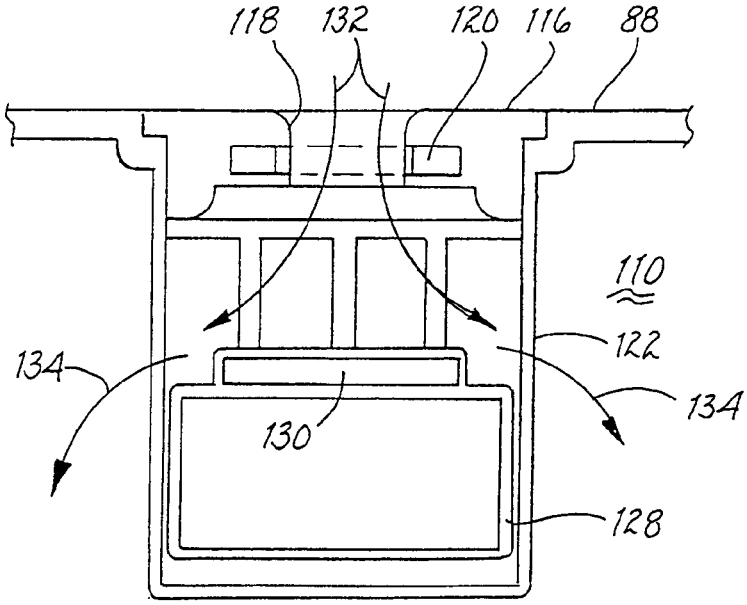
FIG. 3B illustrates the hydraulic suction fuse in a second state resulting from clogging of a drain in a swimming pool.

As particularly shown in FIG. 3B, when float 128 drops to the lower end of basket 122, the water above cover 88 will flow downwardly through aperture 118, as depicted by arrows 132 and into basket 122. As the basket includes a plurality of slots defined by longerons 124 or is otherwise apertured, the water will flow out from basket 122, as depicted by arrows 134 and flow into inlet unit 18. The rate of flow of water through pipe 98 into the debris collection trap above cover 88 is less than the rate of water outflow from the debris collection trap into pipe 20. Hence, aperture 118 will be exposed to the atmosphere. The resulting fluid communication between the interior of inlet unit 18 with the atmosphere (through aperture 118), will essentially eliminate any suction force (vacuum) at stub 40. Such lack of suction force will be translated through pipe 42 to drain 44 resulting in a lack of suction force at the drain. Thus, the suction force tending to retain a body part of a person adjacent the drain will cease to exist and the person will be free to move away from the drain.

Because water level 74 within the debris collection trap will drop and be below water level 102 in pool 82 (see FIG. 2), water will continue to flow through pipe 98 to the top of the debris collection trap. This water flow, being urged by gravity, will be at a lesser rate than the water drawn out of the debris collection trap by pump 22. When air is drawn from the debris collection tank through pipe 20 to pump 22, the impeller associated with the pump will tend to cavitate. Such cavitation will cause the pump not to draw water from the debris collection tank through pipe 20. When drain 44 is no longer obstructed, water will flow through the drain, into pipe 42 and into the debris collection trap as stub 40 is below water level 102 in the pool. The water flowing through aperture 118 of the hydraulic suction fuse into the debris collection trap in combination with the water flowing through stub 40 will fill the debris collection trap as the pump begins cavitating and pumping very little water. As the debris collection tank fills float 128 will rise until, at the urging of the magnetic force of permanent, non-electric magnet 120, closes aperture 118. Thus, the hydraulic suction fuse is self resetting. Such closure will stop further air flow into the debris collection tank and ultimately to pump 22. The downwardly flowing water (but no air) to pump 22 will cause the pump to become primed and begin to draw water from the debris collection tank. Simultaneously, the resulting suction (low pressure) within the debris collection tank will cause water to flow from drain 44 through pipe 42 and through stud 40 into the debris collection tank and normal operation will be resumed.

Figure 5:
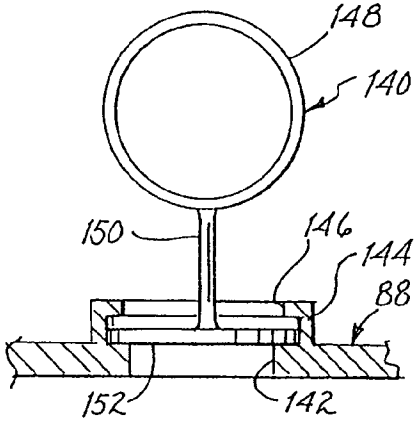
FIG. 5 illustrates a variant hydraulic suction fuse in its first state.

A hydraulic suction fuse variant 140 is shown in FIG. 5. Cover 88 (see FIGS. 2 and 4) includes a generally centrally located aperture 142. A circular shroud 144, including a radially inwardly extending flange 146, extends upwardly about aperture 142. Variant 140 includes a ring 148 having a stem 150 extending therefrom. A flexible disc 152 is mounted at the lower end of the stem. The disc is configured to be captured interiorly of shroud 144 and of greater diameter than the interior diameter of flange 146. Moreover, the disc is of greater diameter than aperture 142.

Figure 6A:
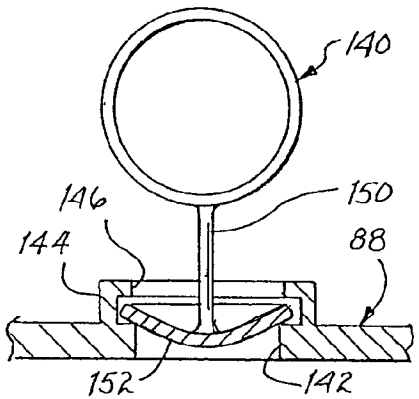
FIGS. 6A, 6B, 6C and 6D illustrate the change in configuration of the variant hydraulic suction fuse being transformed from the first state to a second state.
Figure 6B:
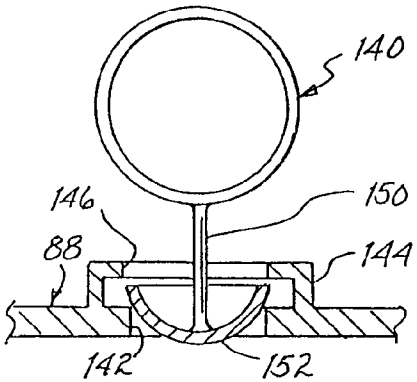
Figure 6C:
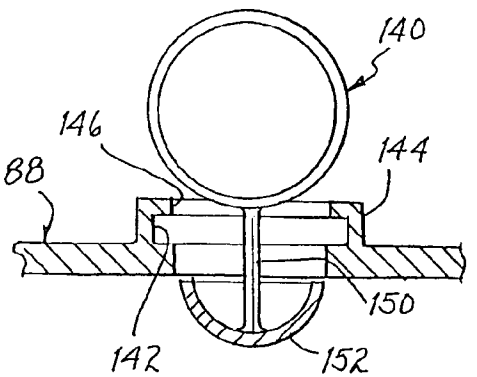
Figure 6D:
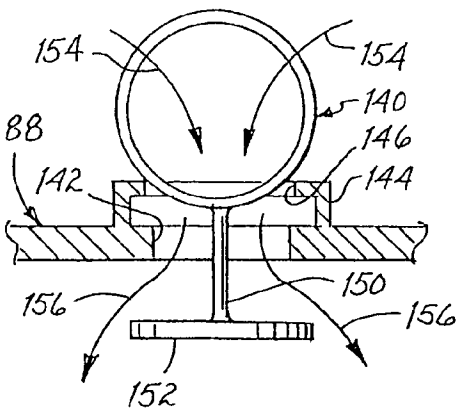

Referring jointly to FIGS. 6A, 6B, 6C and 6D, the function of variant 140 will be described. When water within debris collection trap 80 is drawn out through pipe 20 by pump 22 upon covering or clogging of drain 44, suction (vacuum) is developed within the debris collection trap and such suction is not relieved by an inflow of water through pipe 42. The resulting increase in suction will create a pressure differential across disc 152 causing the disc to bend or bow downwardly as illustrated in FIG. 6A. Such bowing will continue, as shown in FIG. 6B until the diameter of the disc approximates the diameter of aperture 142. Thereafter, the disc will be drawn downwardly below cover 88, as shown in FIG. 6C. Further downward movement of variant 140 is prevented by ring 148 interferingly engaging the interior circular edge of flange 146. However, cover 88 has now been opened, as shown in FIG. 6D. Thereafter, water 62 (see FIG. 2) above cover 88 will flow downwardly, as depicted by arrows 154 and through aperture 142, as depicted by arrows 156. The resulting water flow into debris collection trap 80 will maintain pump 22 primed but because debris collection trap 80 is no longer a closed vessel, insufficient suction will be developed therein to draw water through pipe 42. The lack of water flowing into pipe 42 at drain 44 will relieve any suction present at the drain and should a person have been captured by such suction, the person is now free from restraint and can easily move away from the drain; it is to be understood that due to the difference in the water level and of the swimming pool and the water level in the debris collection trap, gravity will cause a water flow of a limited flow rate and the resulting suction at the drain is of little or no consequence.

Figure 7:
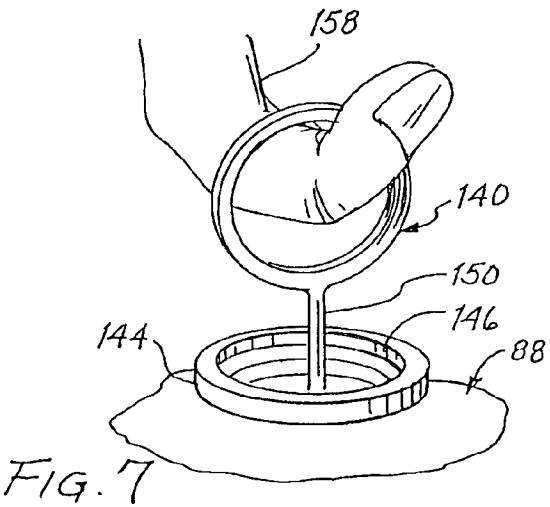
FIG. 7 illustrates manual resetting of the variant hydraulic suction fuse.

Variant 140 may be reset, as figuratively depicted in FIG. 7. That is, a person can engage ring 148 with his/her finger 158 and pull upwardly on variant 140. Such upward pull will relocate disc 152 within the confines of shroud 144 and flange 146 above cover 88 defining aperture 142 and the seal of aperture 142 will be reset.

Figure 8:
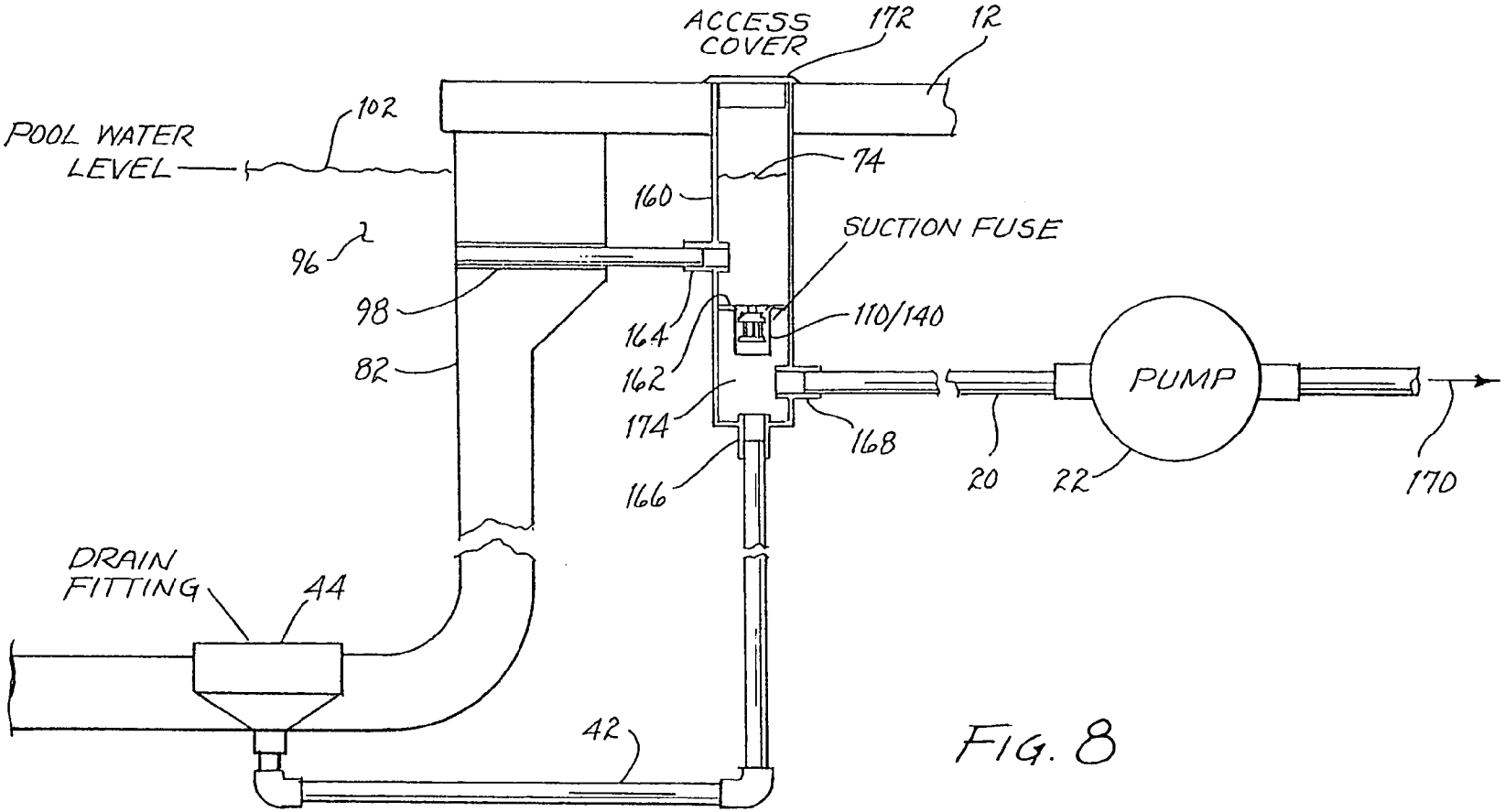
FIG. 8 illustrates a hydraulic suction fuse in line with a swimming pool drain and a pump.

Referring to FIG. 8, there is illustrated a suction fuse 110 or a variant suction fuse 140 at a location adjacent a swimming pool not incorporating a debris collection trap described above. That is, this figure illustrates the possibility of using one of the hydraulic suction fuses described above with any drain, whether at the bottom or in a sidewalk of an existing or to be built swimming pool, spa, or the like.

For elements illustrated in FIG. 8 common with those earlier described, common reference numerals will be used. A cylinder 160 depends from pool deck 12 into the ground. The depth of the cylinder must be sufficient to permit location of the hydraulic suction fuse below water level 102 in swimming pool 82. A bracket 162 supports hydraulic suction fuse 110 in the manner of cover 88 or supports variant hydraulic suction fuse 140 in the manner of cover 88, as shown in FIG. 5 and FIGS. 6A to 6D. Pipe 98 is in fluid communication with water 96 in swimming pool 82 and with the interior of cylinder 160 through stud 164. Thereby, water level 74 within the cylinder is at the same elevation as water level 102 in the swimming pool. Pipe 42 coveys water from drain 44 to stud 166 in fluid communication with the interior of cylinder 160 below bracket 162 (compartment 174). Pipe 20 is in fluid communication with the interior of cylinder 160 below bracket 162 (compartment 174) through stud 168 to convey water to pump 22. The outflow of the pump, represented by arrow 170, is directed to the filtration system of the swimming pool, as is conventional. A conventional cover 172 is removably attached to the upper end of cylinder 160. The cover may include an aperture or fit sufficiently loosely to prevent any pressure differential between the air space at the top of the cylinder and atmospheric pressure.

In operation, in the event drain 44 becomes covered, hydraulic suction fuse 110 will be actuated and air will be caused to enter the cylinder below bracket 162 and be drawn into pump 22, as described above. The resulting lack of suction force within compartment 174 below the bracket will be communicated to drain 44. The resulting lack of suction force at drain 44 will permit easy removal of the material covering the drain or movement of a person away from the drain. Upon such removal of the flow impediment at the drain, compartment 174 will fill through pipe 98 and pipe 42 until hydraulic suction fuse 110 seals itself as a result of the rising water level within compartment 174. Thereafter, flow through the pump from drain 44 will resume.

In the event variant hydraulic suction fuse 140 is actuated, manual resetting of the fuse must be done. Such manual resetting may readily be accomplished by removing cover 172 and reaching into the cylinder to grasp ring 148 of variant hydraulic suction fuse 140 and drawing disc 152 into shroud 144. Thereafter, fluid communication between drain 44 and pump 22 will exist and operation of the pump will resume.

Figure 9:
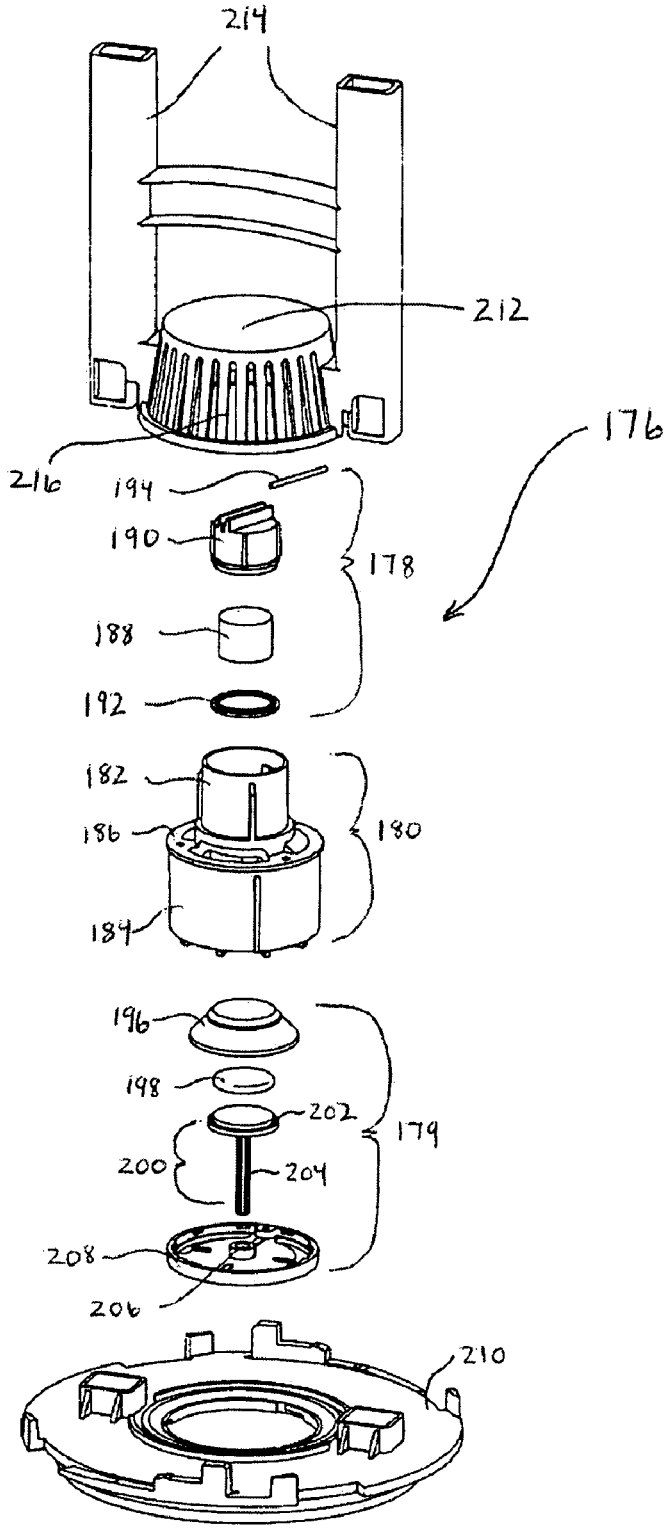
FIG. 9 is an exploded view of an alternate implementation of a hydraulic suction fuse configured for operation in a leaf trap.

Referring to FIG. 9, another non-limiting implementation of a hydraulic suction fuse 176 is illustrated. As illustrated, the hydraulic suction fuse 176 includes a magnet assembly 178 and a fuse 179 comprised in a fuse body 180 which includes a first section 182 coupled to a second section 184 through a coupling flange 186. The magnet assembly 178 includes a magnet 188 coupled between an upper magnet support 190 and a lower magnet support 192. The upper magnet support includes an opening into which a pin 194 may be inserted. The magnet assembly 178 may couple into the first section 182 of the fuse body 180. The fuse 179 includes a fuse cap 196, a attractor portion 198, and a fuse stem 200. As illustrated, the fuse stem 200 includes a cap plate 202 coupled to a guide rod 204 at approximately its center. The rod 204 extends through a guide opening 206 in a second section cap 208 that couples to the second section 184 of the fuse body 180. In the implementation of a hydraulic suction fuse 176 illustrated in FIG. 9, an air intake 212 is coupled over the first and second sections 182, 184 of the fuse body 180 and is also coupled to the fuse body mounting plate 210. Two air towers 214 extend upwardly from the air intake 212 which places the air inlet 216 of the air intake 212 in fluid connection with ambient air. The particular implementation of a hydraulic suction fuse 176 illustrated in FIG. 9 may be used in a debris collection trap in a swimming pool.

Figure 10:
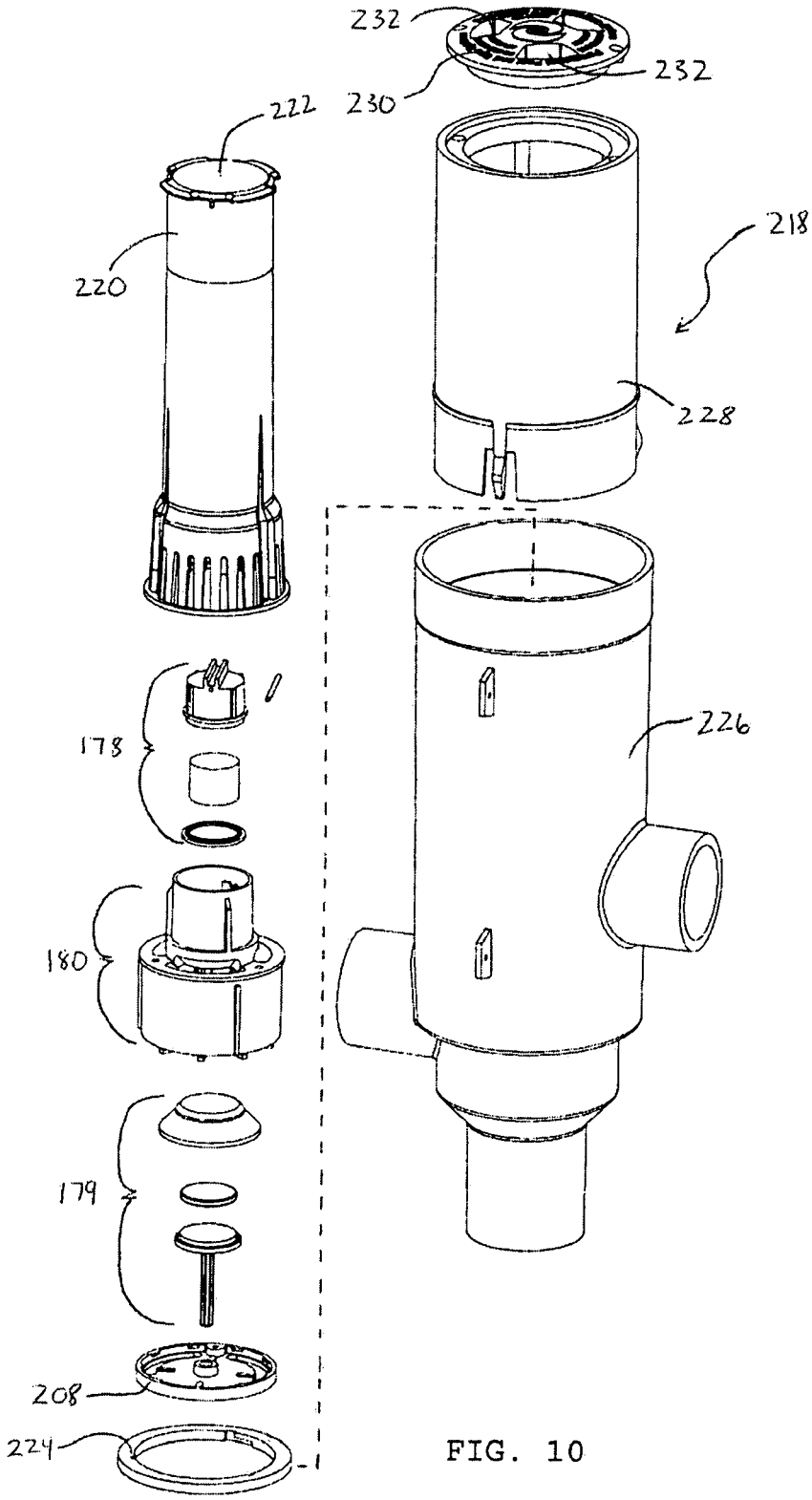
FIG. 10 is an exploded view of another implementation of a hydraulic suction fuse configured for operation in a canister in a pool deck.

Referring to FIG. 10, another particular implementation of a hydraulic suction fuse 218 is illustrated. The hydraulic suction fuse 218 includes a magnet assembly 178, a fuse 179, and a fuse body 180 coupled to a second section cap 208 like the implementation illustrated in FIG. 9. The air intake 220 differs from the implementation illustrated in FIG. 9, however, in that it includes only a single air opening 222. A fuse coupling ring 224 is used to couple the assembled fuse body 180 and air intake 220 into a cylinder 226. The cylinder 226 includes an extension pipe 228 into which the air intake 222 may extend. The extension pipe 228 includes a deck cap 230 which may include a plurality of air vents 232 therethrough to allow fluid communication of ambient air through the extension pipe 228 into the air intake 220. The particular implementation of a hydraulic suction fuse 218 illustrated in FIG. 10 may be used in a canister embedded in a swimming pool deck.

Figure 11:
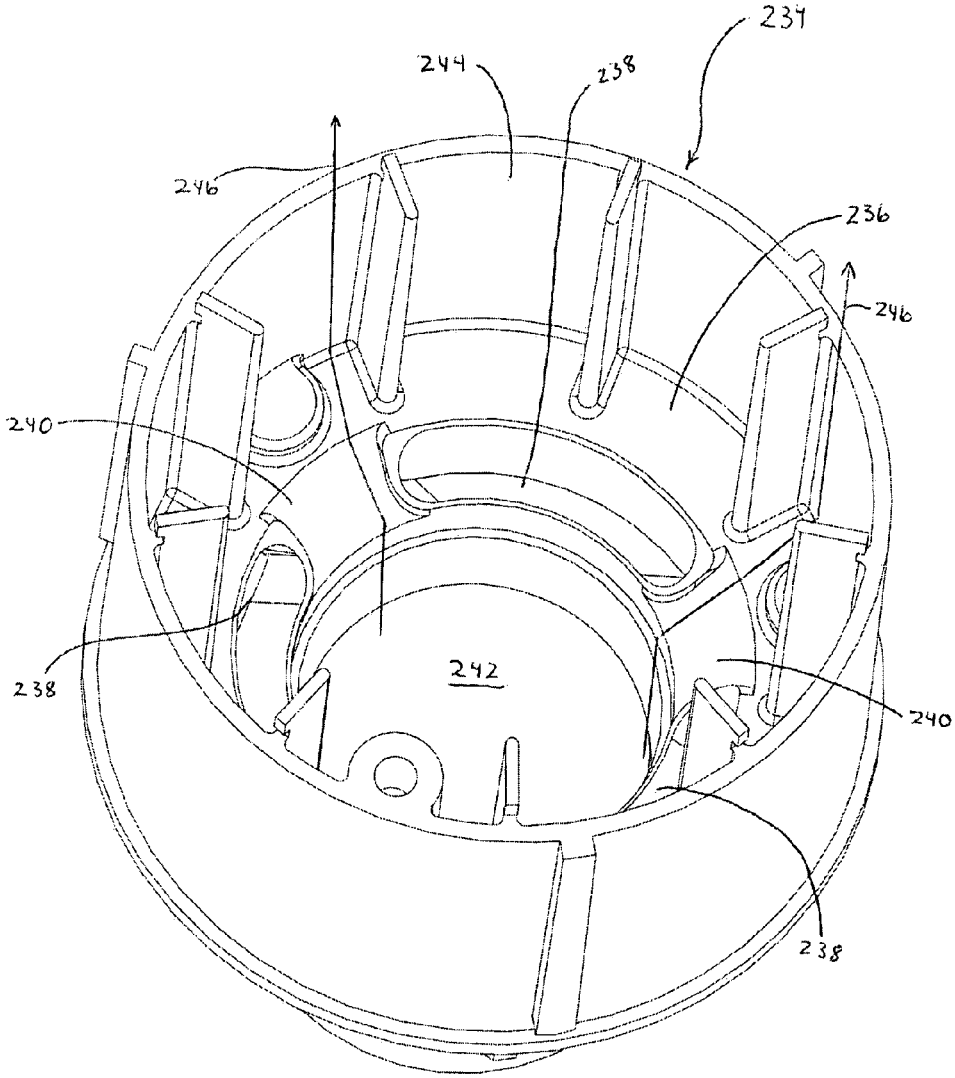
FIG. 11 is a bottom perspective view of a particular implementation of a fuse body.

FIG. 11 illustrates a particular implementation of a fuse body 234 in an inverted perspective view when compared with the views shown in FIGS. 9 and 10 to show the bottom of the fuse body 234. As illustrated, the coupling flange 236 includes a plurality of suction channels 238 therethrough. The suction channels 238 for this particular implementation are angled, although in other particular implementation, the suction channels 238 may not be angled. The coupling flange 236 may also include a plurality of release channels 240 therein, which comprise grooved areas between the suction channels 238 that allow for a pressure balance above and below the fuse body 234. When the fuse cap 196 is present in the top aperture 242 of the fuse body 234 (i.e. the fuse is closed), the release channels 240 permit fluid pressure (water, ambient air, or both) to balance above and below the fuse body 234 Indicator lines 246 illustrate a path through the release channels 240. If the suction force developed within the second section 244 of the fuse body 234 is sufficiently large, fluid begins to flow through the suction channels 238, pushing the fuse cap 196 downward into the second section 244, opening the hydraulic suction fuse and allowing air into the pump.

Figure 12:
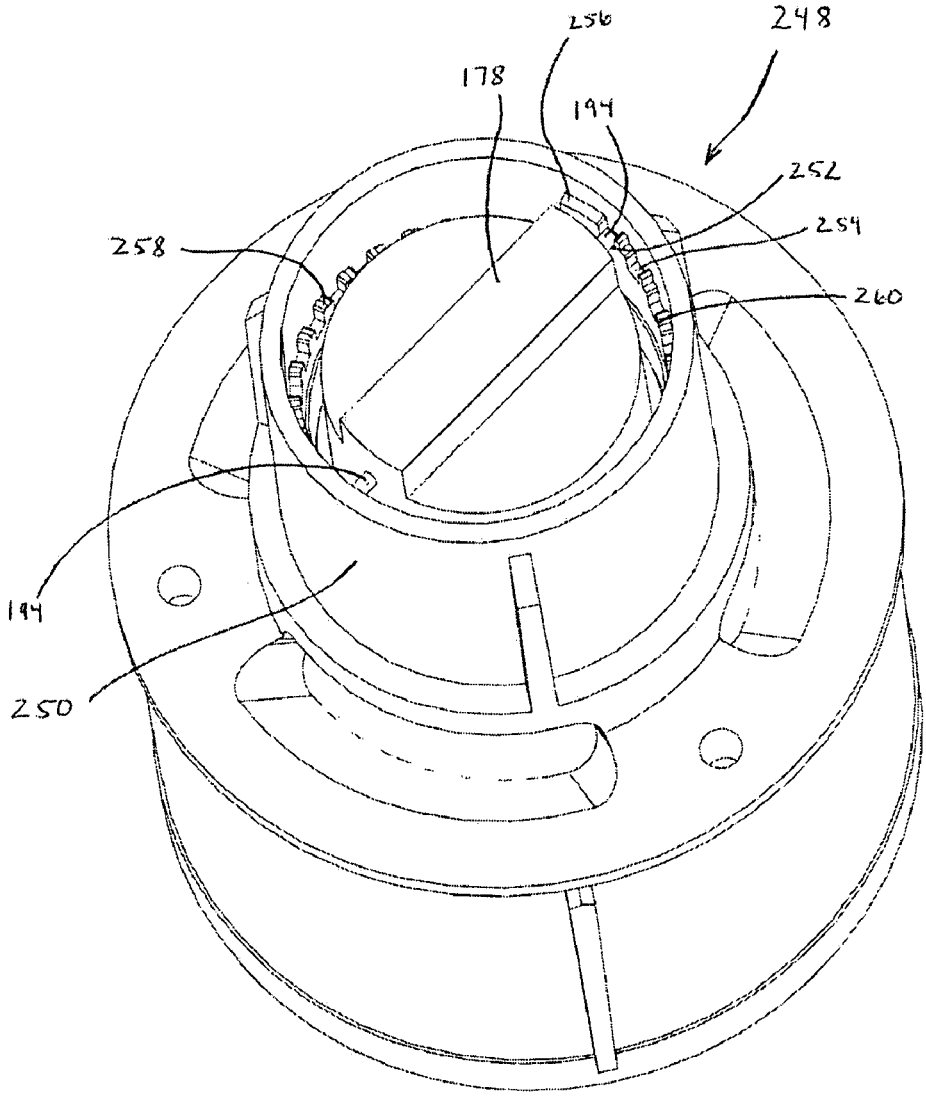
FIG. 12 is a top perspective view of another particular implementation of a fuse body with a magnet assembly coupled into a first section of the fuse body.

Referring to FIG. 12, a top perspective view of a particular implementation of a fuse body 248 is illustrated with a magnet assembly 178 coupled into the first section 250 of the fuse body 248. The first section 250 of the fuse body 248 may comprise a first step 252 into which a pin 194 of the magnet assembly 178 may rest or otherwise couple. The first step 252 has a first height, measured as the distance between a topmost shelf 256 and the bottom of the first step 252. A second step 254 may also be included in the first section 250 of the fuse body 248, having a second distance, where the second distance is further downward or upward than the first distance. A plurality of other steps, each with a distance further downward or upward than the adjacent step may be sequentially arranged within the first section 250 of the fuse body 248, creating a downwardly or upwardly spiraling series of steps sized to engage with the pin 194 of the magnet assembly 178. As illustrated, two sets of steps 258,260 are included, each set spiraling around half of the perimeter of the first section 250 of the fuse body 248, though any number of steps or sets of steps may be included. When a pin 194 is used that extends through both sides of the magnet assembly 178, the two sets of steps 258,260 may permit the magnet assembly 178 to be raised upwardly or lowered downwardly the same distance into or out of the first section 250 of the fuse body 248. While the implementation illustrated in FIG. 12 utilizes a pin 194 to engage with the steps 258, 260, other structures, such as, by non-limiting example, projections from the magnet assembly 178, bearings, wire, or any other engaging structure configured to engage with the steps 258,260 could be used in other particular implementations.

Figure 13:
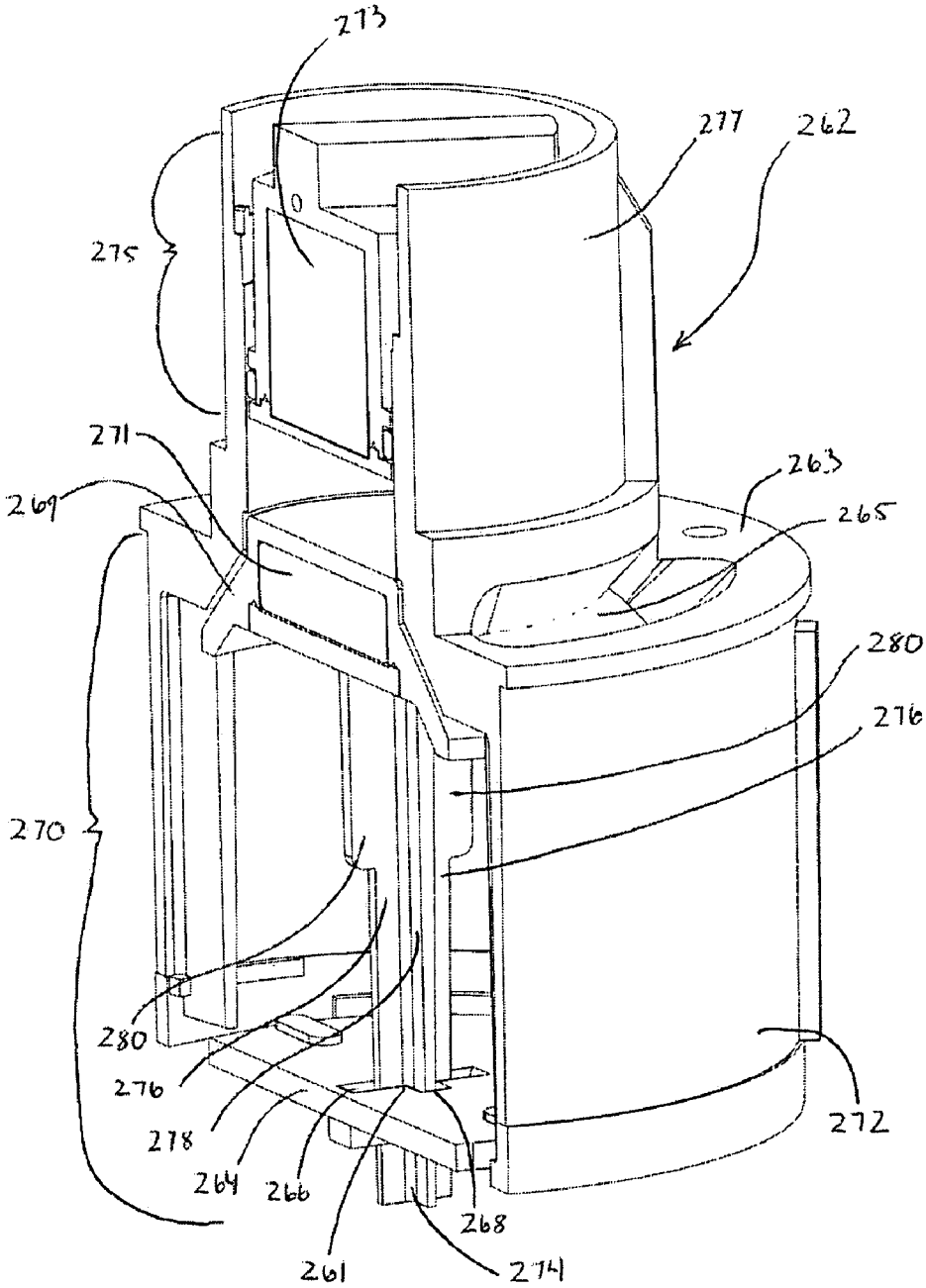
FIG. 13 is a cross section perspective view of yet another particular implementation of fuse body with a magnet assembly and a fuse coupled into the first and second sections, respectively of the fuse body.

Referring to FIG. 13, a cross sectional view of a particular implementation of a fuse body 262 is illustrated. As illustrated, the fuse body 262 includes a second section cap 264 that contains a guide opening 261 therethrough composed of first and second slots 266, 268. As illustrated, first slots 266 may be longer than second slots 268. A fuse 270 is shown coupled into the second section 272 of the fuse body 262. The fuse 270 includes a rod 274 having first and second fins 276, 278 extending therefrom. As illustrated, in particular implementations of a fuse, the first fins 276 may be sized substantially the same as the second fins 278 up to a certain point on the rod 274, where fin extensions 280 project outwardly from the first fins 276. The first fins 276, in combination with the fin extensions 280, may be sized to slide through the first slots 266 in the guide opening 261, but not through the second slots 268. Accordingly, depending upon how the rod 274 is oriented relative to the first and second slots 266, 268 when the rod 274 is inserted into the guide opening 261 in the second section cap 264, the rod 274 may be able to slide through the guide opening 261 for a majority of its length or may be limited to sliding until the fin extensions 280 encounter the edges of the second slots 268.

Referring to FIG. 13, implementations of a hydraulic suction fuse comprise an open position and a closed position. The hydraulic suction fuse may be considered to be in a closed position (as shown in FIG. 13) when the fuse 270 is under the influence of magnetic force from the magnet 273 in the first section 277 of the fuse body 262 and the fuse cap 269 is coupled within the coupling flange 263 of the fuse body 262, closing the suction channels 265. When suction force within the second section 272 of the fuse body 262 increases to a critical level (for example, when a swimmer has contacted the drain) ambient atmospheric pressure force against the fuse cap 269 through the suction channels 265 may overcome the magnetic force between the attractor portion 271 and the magnet 273 and may push the fuse 270 downward, allowing fluid (air, water, or both air and water) to flow through the suction channels 265 and into the pump inlet. The hydraulic suction fuse is in an open position when the fuse 270 is not seated against or is otherwise decoupled from the coupling flange 263 of the fuse body 262, the hydraulic suction fuse is in an open position.

Referring to FIGS. 11 and 13, during normal operation of the pool, opening of the fuse 270 from ordinary swings of pressure force within the second section 272 of the fuse body may be avoided by use of release channels 240, which allow a balance of differential pressure between the first and second sections, 277, 272 of the fuse body 262. Because of the ability of the hydraulic suction fuse to handle ordinary pressure swings through the release channels 240, the rapidity of the response of the hydraulic suction fuse to the increase in suction force when a swimmer is actually trapped by the drain may be greatly increased. In particular implementations, the fuse may be opened by a pressure differential as small as about 5 to about 18 inches of mercury. The ability to obtain an economy of magnetic force in the hydraulic suction fuse may also be enhanced in particular implementations by the angle of the suction channels 265. The suction channels 265 illustrated in FIG. 13 are angled about 45 degrees from vertical. In other implementations of a fuse body, however, the suction channels 265 may be angled from about 0 degrees to about 90 degrees from vertical. The sensitivity of the hydraulic suction fuse may be adjusted by adjusting the distance between the attractor portion and the magnet.

Implementations of hydraulic suction fuses may also include methods of use and operation. Particular implementations may include hydraulic suction fuses that reset automatically after suction force within the hydraulic suction fuse decreases, allowing the fuse to return from the open to the closed position. Automatic reset of the fuses may be desirable because after a swimmer has been released from the drain, the pump is again able to begin cycling water through the system by pulling water through the drain without requiring human intervention. Referring to FIG. 13, a hydraulic suction fuse may be configured for automatic resetting when, during assembly, the first fin 276 is inserted into the second slot 268. Because the first fin 276 has a fin extension 280, the ability of the rod 274 to pass through the second slot 268 is limited to the distance from the end of the rod 274 to the fin extension 280. The length of the fin extension 280 down the rod 274 can be selected so that the attractor portion 271 of the fuse 270 remains in the influence of the magnetic force emanating from the magnet 273 included in the magnet assembly 275. Because the attractor portion 271 remains attracted to the magnet 273, when the fuse is in the open position, the fuse 270 can still automatically rise back up into the closed position as the suction force within the second section 272 of the fuse body 262 decreases.

A hydraulic suction fuse may be configured for manual resetting when, during assembly, the first fin 276 is coupled into the first slot 266. Because the first slot 266 is larger than the second slot 268 and may be sized to allow the fin extension 280 to pass through it, when the hydraulic suction fuse is in the open position, a majority of the rod 274 of the fuse 270 will slide through the first and second slots 266, 268 in the second section cap 264. Because the fuse 270 is able to travel further away from the magnetic force emanating from the magnet 273, when the suction force within the second section 272 of the fuse body 262 decreases, the fuse cannot return to the closed position on its own. Instead, the fuse 270 may be manually brought upward into the magnetic force emanating from the magnet 273 by an operator or service personnel. Once the fuse 270 is held by the magnetic force, it will remain there until the suction force in the second section 272 indicates that a swimmer or other object is blocking the drain.

Implementations of hydraulic suction fuses may also include a method for adjusting the fuse point of a hydraulic suction fuse. The fuse point represents the amount of increased suction force the fuse may experience before moving from the closed to the open position and introducing air into the pump. Referring to FIGS. 12 and 13, the fuse point may be set in particular implementations by adjusting the distance between the magnet assembly 178 and the fuse 170. Since the distance the fuse 170 extends into the coupling flange 263 is fixed, by moving the magnet assembly 178 upward away from the fuse 170, the fuse point can be reduced, or in other words, the amount of suction force required to open the fuse is reduced. By moving the magnet assembly 178 toward the fuse 170, the fuse point can be increased. A method of adjusting the fuse point comprises adjusting the distance between the magnet assembly 178 and the attractor portion 271. In one particular implementation, this method may comprise the steps of decoupling the magnet assembly 178 from a first step 252 having a first height, rotating the magnet assembly 178, and coupling the magnet assembly 178 with a second step 254 having a second height. In this method, the second distance of the second step 254 may be either larger or smaller relative to the first distance of the first step 252 depending on whether the magnet assembly 178 is being adjusted downwardly or upwardly to raise or lower the fuse point, respectively. The magnet assembly 178 may be coupled with the first and second steps 252, 254 with a pin 194.

The invention claimed is:

1. A method for relieving the suction force of a drain in a swimming pool or spa using a hydraulic suction fuse having a permanent, non-electric magnet, the method comprising:

setting a hydraulic suction fuse;

opening the hydraulic suction fuse by increasing suction force within the hydraulic suction fuse and by overcoming a magnetic force from the permanent, non-electric magnet within the hydraulic suction fuse;

resetting the hydraulic suction fuse through magnetic force from the permanent, non-electric magnet.

2. The method of claim 1, wherein the resetting of the hydraulic suction fuse comprises automatically resetting the hydraulic suction fuse through the magnetic force when the suction force is decreased within the hydraulic suction fuse.

3. The method of claim 2, wherein the automatically resetting the hydraulic suction fuse comprises:

automatically closing an aperture in the hydraulic suction fuse through the magnetic force.

4. The method of claim 1, wherein the resetting of the hydraulic suction fuse comprises manually resetting the hydraulic suction fuse.

5. The method of claim 1, wherein setting the hydraulic suction fuse comprises:

determining whether to increase or decrease a fuse point of the hydraulic suction fuse; and adjusting a distance between a magnet assembly introducing the magnetic force and an attractor portion to adjust the fuse point.

6. The method of claim 5, wherein adjusting the distance between the magnet assembly and the attractor portion comprises:

decoupling the magnet assembly from a first step in a fuse body of the hydraulic suction fuse, the first step comprising a first height; and coupling the magnet assembly with a second step in the fuse body, the second step comprising a second height different from the first height.

7. The method of claim 5, wherein adjusting the distance between the magnet assembly and the attractor portion comprises rotating the magnet assembly.

8. The method of claim 5, further comprising coupling the magnet assembly with the first step and the second step through a pin.

9. The method of claim 1, wherein opening the hydraulic suction fuse comprises opening an aperture in the hydraulic suction fuse.

10. The method of claim 9, wherein resetting the hydraulic suction fuse comprises closing the aperture in the hydraulic suction fuse.

11. The method of claim 1, wherein opening the hydraulic suction fuse further comprises drawing air into the hydraulic suction fuse.

12. The method of claim 1, wherein opening the hydraulic suction fuse further comprises causing ambient fluid from outside the hydraulic suction fuse to flow through the hydraulic suction fuse and into a pump inlet coupled to the drain.

13. The method of claim 1, further comprising submerging the hydraulic suction fuse in water prior to opening the hydraulic suction fuse.

14. A method for relieving the suction force of a drain in a swimming pool or spa using a hydraulic suction fuse having a permanent, non-electric magnet, the method comprising:

submerging a hydraulic suction fuse in water below a water level of the swimming pool or spa;

setting the hydraulic suction fuse through magnetic force attracting a permanent, non-electric magnet to an attractor;

opening the hydraulic suction fuse and causing ambient fluid from outside the hydraulic suction fuse to flow through the hydraulic suction fuse and into a pump inlet coupled to the drain by increasing suction force within the hydraulic suction fuse and by overcoming the magnetic force from the permanent, non-electric magnet;

resetting the hydraulic suction fuse through the magnetic force from the permanent, non-electric magnet.

15. The method of claim 14, wherein the resetting of the hydraulic suction fuse comprises automatically resetting the hydraulic suction fuse when the suction force is decreased within the hydraulic suction fuse.

16. The method of claim 14, wherein setting the hydraulic suction fuse comprises:

determining whether to increase or decrease a fuse point of the hydraulic suction fuse; and adjusting a distance between the permanent, non-electric magnet and an attractor portion in accordance with the determination.

17. The method of claim 16, wherein adjusting the distance between the permanent, non-electric magnet and the attractor portion comprises:

decoupling the permanent, non-electric magnet from a first step in a fuse body of the hydraulic suction fuse, the first step comprising a first height; and coupling the permanent, non-electric magnet with a second step in the fuse body, the second step comprising a second height different from the first height.

18. The method of claim 16, wherein adjusting the distance between the permanent, non-electric magnet and the attractor portion comprises rotating the permanent, non-electric magnet.

* * * * *